US011761735B2

(12) United States Patent
Betzalel

(10) Patent No.: US 11,761,735 B2
(45) Date of Patent: Sep. 19, 2023

(54) BUTTSTOCK PERISCOPE ASSEMBLY

(71) Applicant: Sasson Betzalel, Jerusalem (IL)

(72) Inventor: Sasson Betzalel, Jerusalem (IL)

( * ) Notice: Subject to any disclaimer, the term of this patent is extended or adjusted under 35 U.S.C. 154(b) by 0 days.

(21) Appl. No.: 17/701,907

(22) Filed: Mar. 23, 2022

(65) Prior Publication Data

US 2022/0325983 A1 Oct. 13, 2022

(30) Foreign Application Priority Data

Apr. 11, 2021 (IL) ..... 282244

(51) Int. Cl.
*F41G 1/41* (2006.01)
*F41C 23/22* (2006.01)

(52) U.S. Cl.
CPC ..... *F41G 1/41* (2013.01); *F41C 23/22* (2013.01)

(58) Field of Classification Search
CPC ..... F41G 1/40; F41G 1/41; F41C 23/22
See application file for complete search history.

(56) References Cited

U.S. PATENT DOCUMENTS 1,174,282 A * 3/1916 Richard ..... F41G 1/40 42/118
2,627,132 A * 2/1953 Dolgacius ..... F41G 1/41 89/37.03
3,863,354 A * 2/1975 Karppinen ..... F41G 1/30 42/114
3,919,921 A * 11/1975 Schirneker ..... F41G 1/30 89/132
4,878,305 A * 11/1989 Gabrielidis ..... F41A 19/09 42/118
2004/0144010 A1* 7/2004 Golan ..... F41C 23/04 42/72

FOREIGN PATENT DOCUMENTS

FR 438319 A * 5/1912
FR 2614689 A1 * 11/1988
GB 191508017 A * 1/1916
GB 555356 A * 8/1943

* cited by examiner

*Primary Examiner* — Gabriel J. Klein
(74) *Attorney, Agent, or Firm* — Dekel Patent Ltd.; David Klein

(57) ABSTRACT

An assembly includes a forward unit including a mounting portion for mounting thereon a firearm, the forward unit defining a projectile shooting axis, and a rearward unit coupled to the forward unit. The rearward unit includes a retractable buttstock that has a retracted position and an extended position. In the extended position the rearward unit is pivotable with respect to the forward unit about a pivot axis which is tilted relative to the projectile shooting axis.

10 Claims, 13 Drawing Sheets

BUTTSTOCK PERISCOPE ASSEMBLY

FIELD OF THE INVENTION

The present invention relates to firearms in general and, in particular, to a buttstock with a periscope assembly.

BACKGROUND OF THE INVENTION

When firing firearms, the force of the expanding gas that propels the bullet down the barrel forces the firearm rearwards in a recoil action. Accordingly, many firearms, such as rifles, shotguns, and other types of firearms, include a buttstock for engaging the shooter's shoulder when firing the firearm to help support the firearm during a recoil action.

Numerous firearms include or may be modified to include an adjustable buttstock. Adjustable and/or collapsible buttstocks allow a user to change a length of pull and overall firearm length to suit a specific user and/or a specific situation (e.g., to compensate for a user with longer or shorter arms or a user wearing thicker clothes, including body armor).

SUMMARY OF THE INVENTION

The present invention seeks to provide a novel buttstock equipped with a periscope, as is described further hereinbelow.

There is thus provided in accordance with a non-limiting embodiment of the present invention a buttstock periscope assembly including a buttstock, and an image receiving surface and an image viewing surface mounted in or on the buttstock, the image receiving surface and the image viewing surface having deployed positions in which the image receiving surface and the image viewing surface are spaced from each other, and images captured by the image receiving surface are viewed at the image viewing surface.

In accordance with a non-limiting embodiment of the present invention the image receiving surface is aligned with a shooting axis associated with the buttstock.

In accordance with a non-limiting embodiment of the present invention the image receiving surface and the image viewing surface are each pivotable about a pivot.

In accordance with a non-limiting embodiment of the present invention the image receiving surface and the image viewing surface include reflective surfaces.

In accordance with a non-limiting embodiment of the present invention the image receiving surface and the image viewing surface are mounted in a hollow portion of the buttstock.

In accordance with a non-limiting embodiment of the present invention the buttstock includes a viewing window for viewing the image viewing surface.

In accordance with a non-limiting embodiment of the present invention the image receiving surface is mounted on a gimbal so that the image receiving surface is pivotable in two angular directions.

In accordance with a non-limiting embodiment of the present invention the buttstock includes a first rear access door that covers the image receiving surface.

In accordance with a non-limiting embodiment of the present invention the buttstock includes a second rear access door that covers the image viewing surface.

In accordance with a non-limiting embodiment of the present invention the buttstock includes an inclined surface upon which the image viewing surface is abuttable in the deployed position.

In accordance with a non-limiting embodiment of the present invention the image receiving surface includes a camera and the image viewing surface includes a screen configured to display images received by the image receiving surface.

In accordance with a non-limiting embodiment of the present invention the image viewing surface is translatable.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Reference is now made to FIGS. 1-4, which illustrate a buttstock periscope assembly 10, in accordance with a non-limiting embodiment of the present invention.

The assembly includes a buttstock 12, which may be externally constructed to fit many firearms, such as rifles, shotguns, and other types of firearms, as is known in the art. As such, for example, the buttstock 12 may be an adjustable buttstock that includes a lock release lever 11 and an aperture 13 for a strap or a strap quick release mechanism (not shown).

Figure 1:
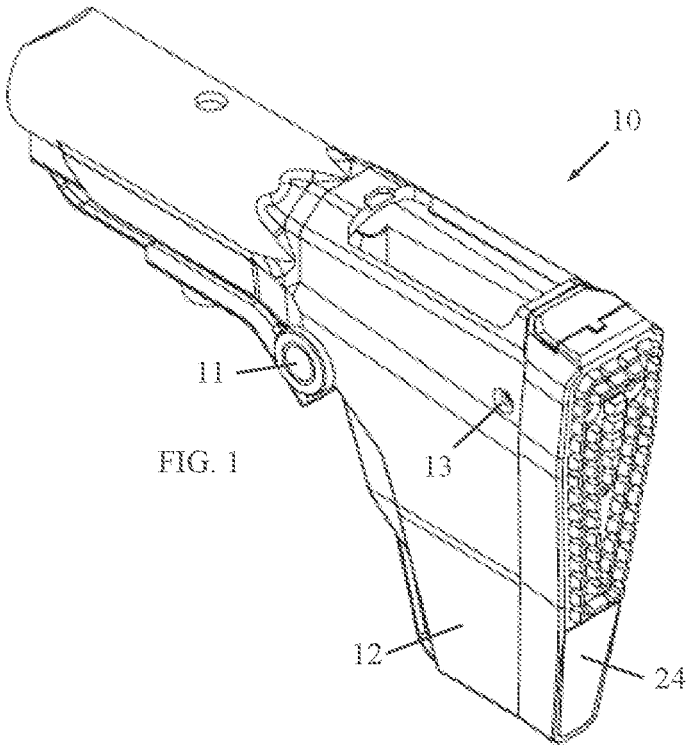
FIGS. 1 and 2 are simplified perspective and sectional illustrations of a buttstock, in accordance with a non-limiting embodiment of the present invention, including image receiving and image viewing surfaces of a periscope, wherein the image receiving and image viewing surfaces are in retracted positions.
Figure 2:
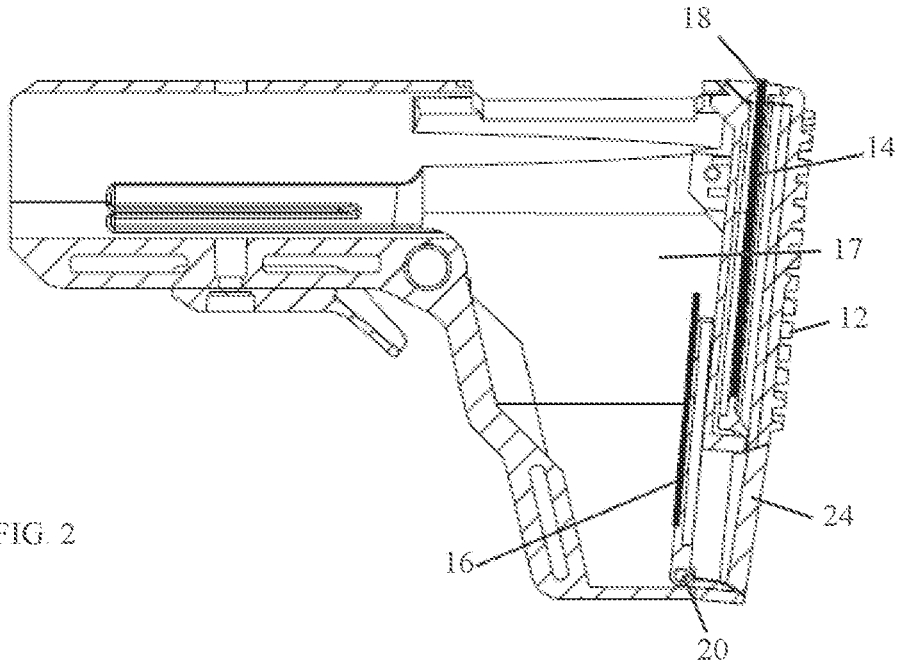
Figure 3:
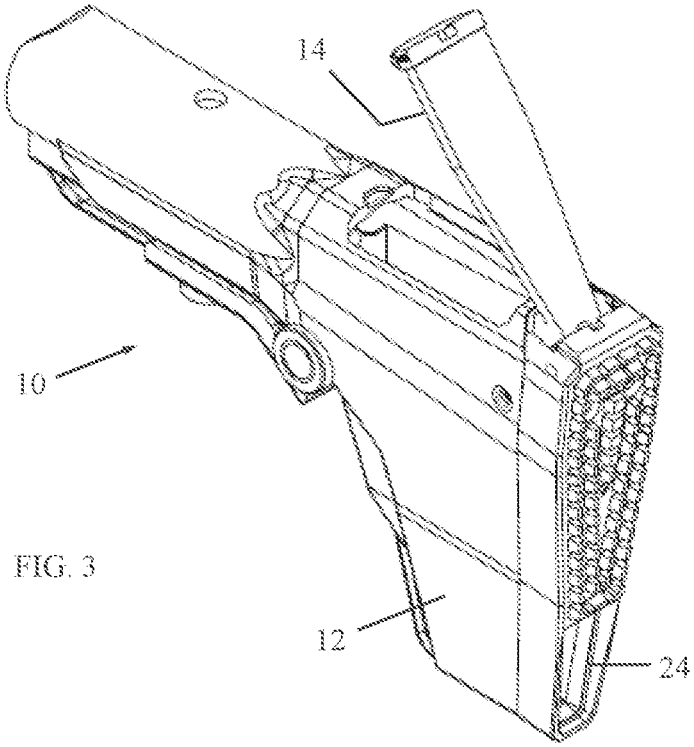
FIGS. 3 and 4 are simplified perspective and sectional illustrations of the buttstock, in which the image receiving and image viewing surfaces are in deployed positions.
Figure 4:
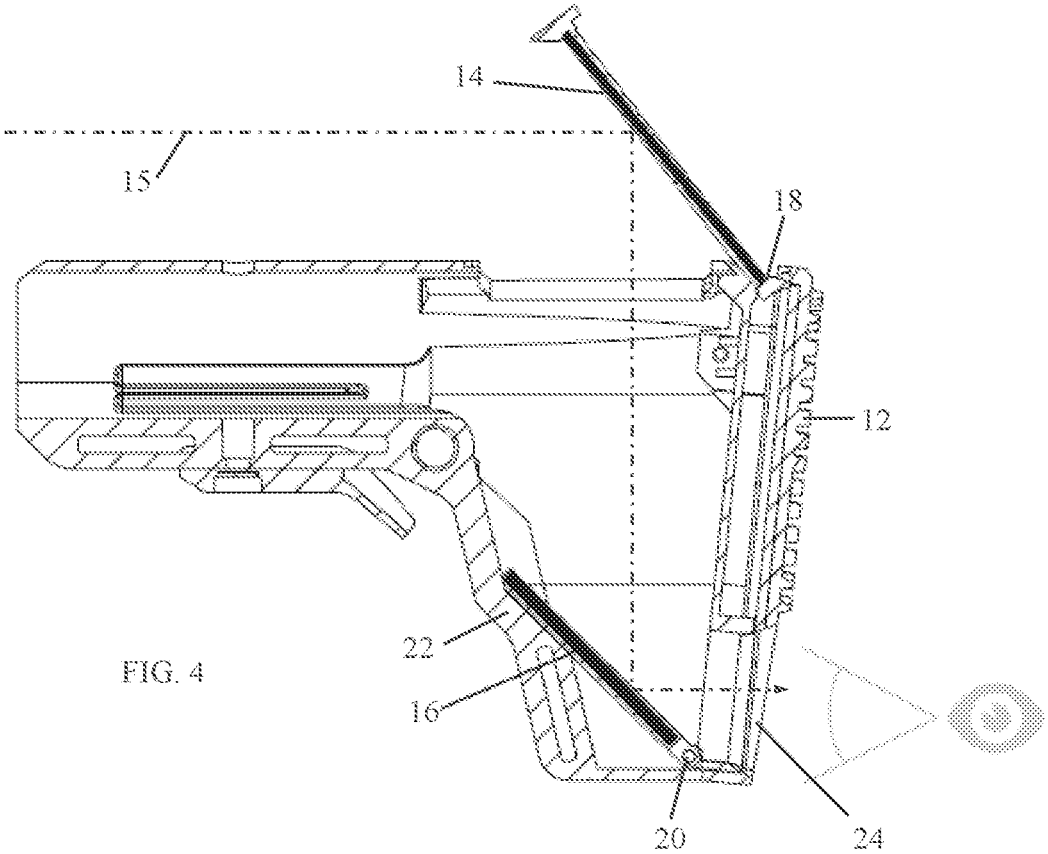
Figure 5:
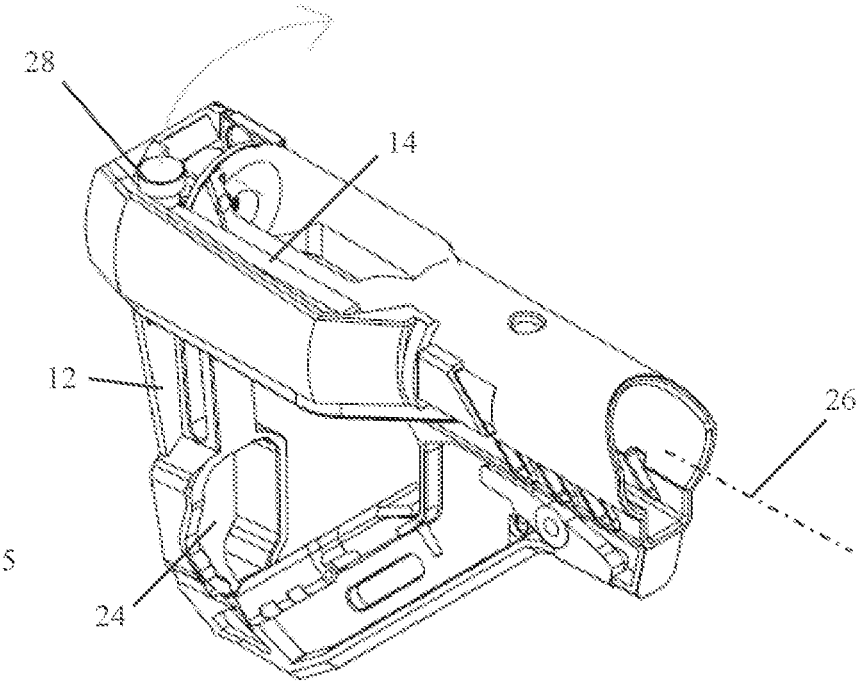
FIGS. 5 and 6 are simplified perspective and sectional illustrations of a buttstock, in accordance with another non-limiting embodiment of the present invention, in which the image receiving surface of a periscope is in a retracted position.
Figure 6:
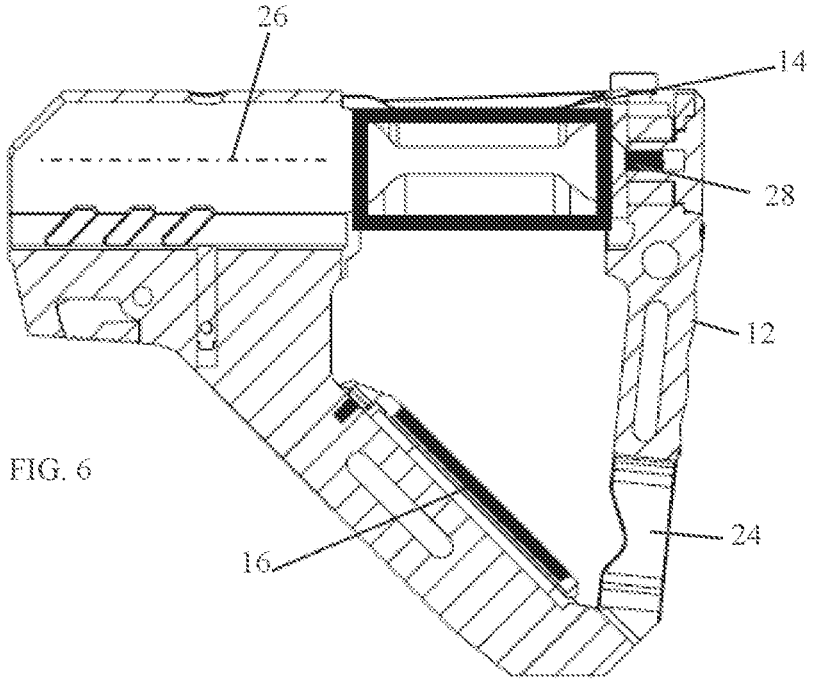

As seen in FIG. 2, the buttstock periscope assembly 10 may include an image receiving surface 14 and an image viewing surface 16 mounted in or on buttstock 12, such as in a hollow portion 17 of buttstock 12. In this embodiment, image receiving surface 14 and image viewing surface 16 are both reflective surfaces (mirrors) which are pivoted about pivots 18 and 20, respectively. In FIGS. 1 and 2, the image receiving and image viewing surfaces 14 and 16 are in retracted positions, whereas in FIGS. 3 and 4, they have been pivoted to be in deployed positions. The pivots 18 and 20 may include lockable pivots (e.g., with detents or ratchets or other elements) which lock in the retracted and deployed positions so that they remain steady during firing of the firearm.

In the deployed position, image receiving surface 14 and image viewing surface 16 are spaced from each other, and the image receiving surface 14 is aligned with a shooting axis 15 (FIG. 4) associated with buttstock 12 (which is the shooting axis of the weapon) so that image receiving surface 14 is configured to capture images of the target the shooter wishes to shoot. The images captured by image receiving surface 14 are viewed by the shooter at image viewing surface 16. Thus, image receiving surface 14 and image viewing surface 16 form a periscope.

Figure 25:
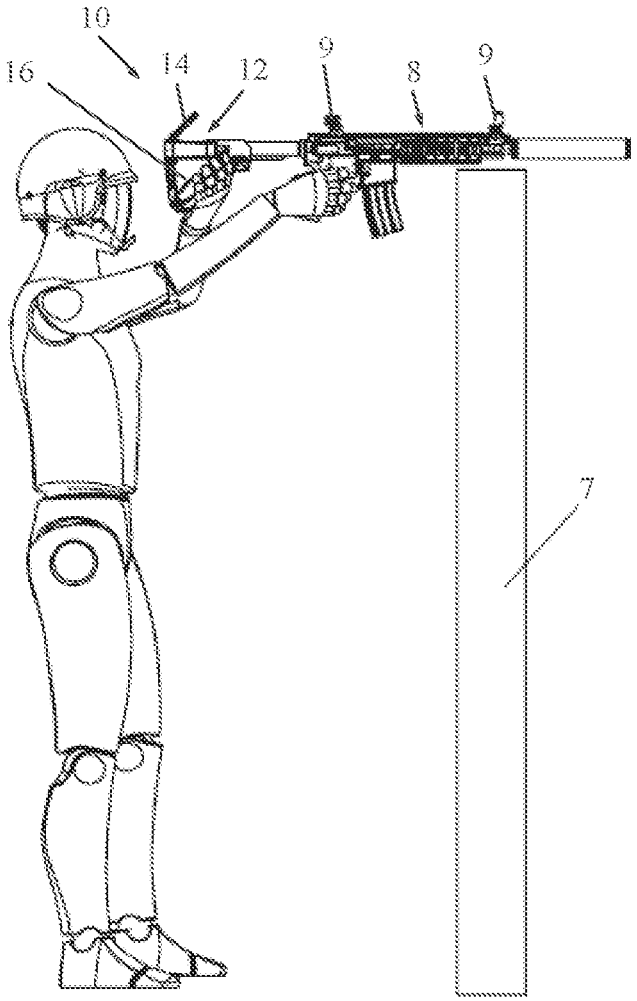
FIG. 25 is a simplified perspective illustration of a shooter behind a protective wall and using the periscope of the invention.

Buttstock 12 may include an inclined surface 22 upon which the image viewing surface 16 can abut or rest in the deployed position. Buttstock 12 may include a viewing window 24 for viewing the image viewing surface 16. Window 24 may be open or may be closed with a transparent cover. As seen in FIG. 25, a shooter can stand behind a protective wall 7 and use the periscope assembly 10 of the invention to shoot a weapon 8 safely behind the protective wall 7. It is seen that the image receiving surface 14 is aligned with one or more sights 9 of weapon 8.

Reference is now made to FIGS. 5-8, which illustrate another version of the buttstock assembly, with like elements being designated by like numerals. In this version, the image receiving surface 14 is stored in a folded position (FIGS. 5 and 6), in which image receiving surface 14 is turned about a longitudinal axis 26 (such as by 90°) of the buttstock 12 (the longitudinal axis 26 is the shooting axis or parallel thereto). Accordingly, in this embodiment, the image receiving surface 14 is mounted on a gimbal 28 so that the image receiving surface 14 is pivotable in two angular directions: elevation (between the retracted and deployed positions about pivot 18, as described above) and roll (about the longitudinal axis 26).

Figure 7:
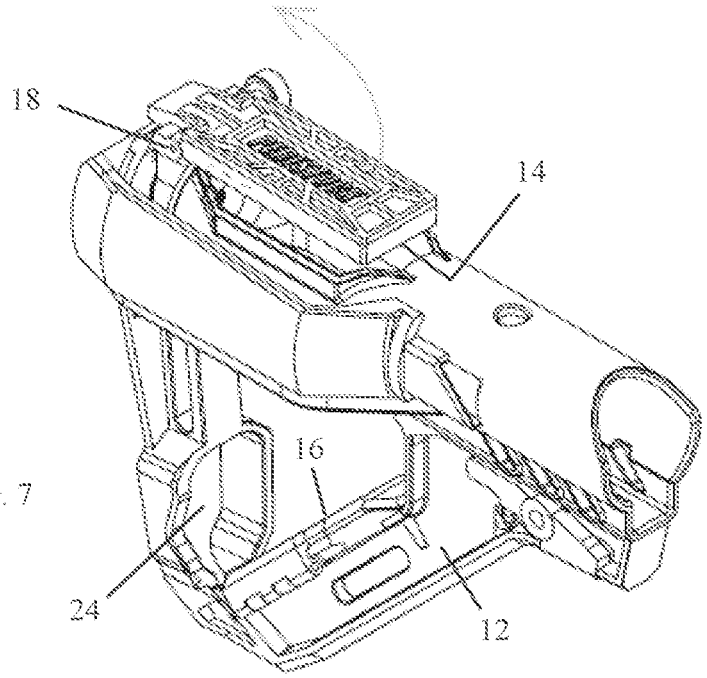
FIGS. 7 and 8 are simplified perspective and sectional illustrations of the buttstock of FIGS. 5 and 6, in which the image receiving surface of the periscope has been pivoted to a pre-deployed position.
Figure 8:
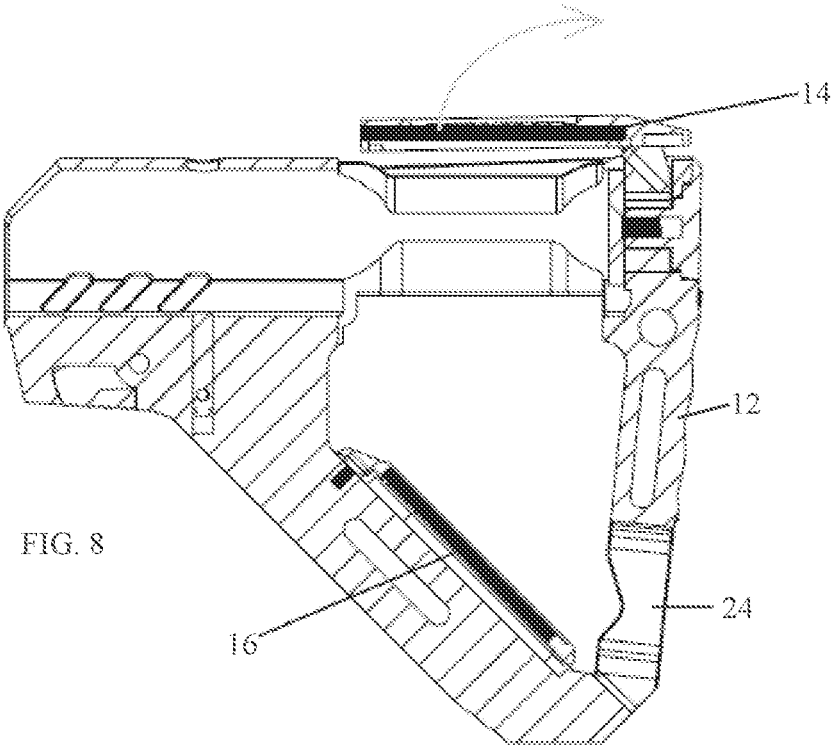
Figure 9:
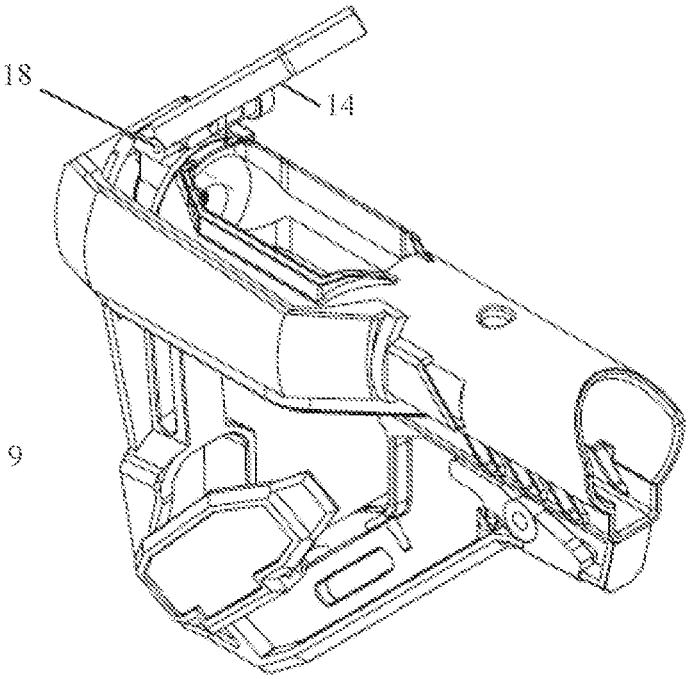
FIGS. 9 and 10 are simplified perspective and sectional illustrations of the buttstock of FIGS. 5 and 6, in which the image receiving surface is in a deployed position.
Figure 10:
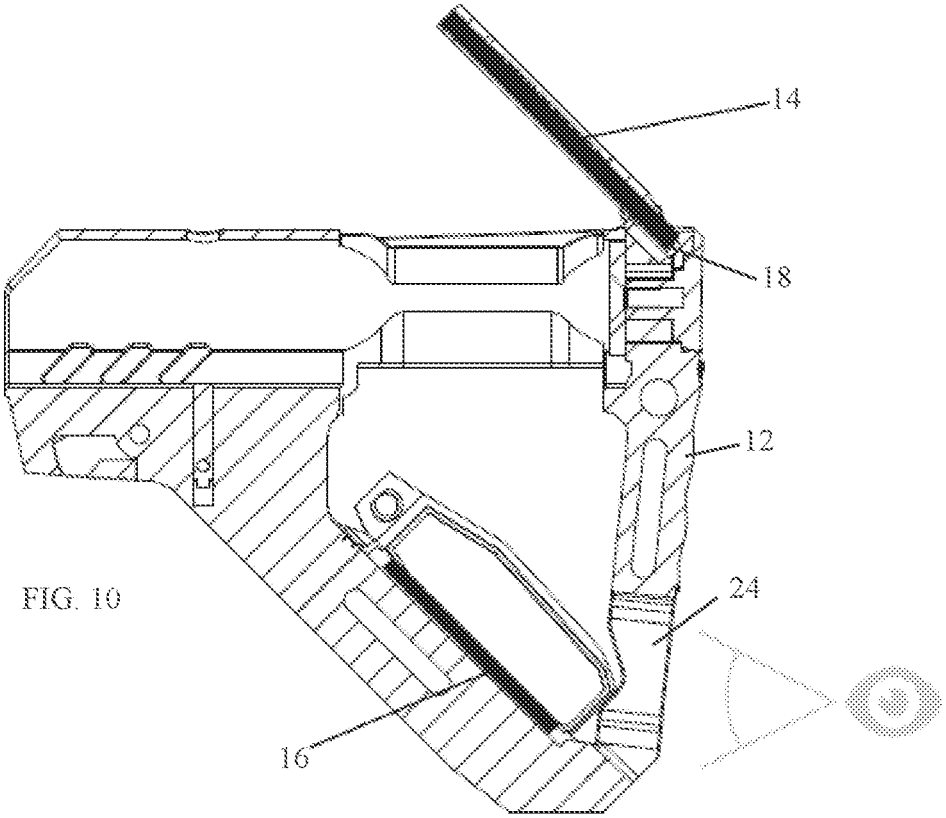

FIGS. 7 and 8 show the image receiving surface 14 of the periscope pivoted in roll to a pre-deployed position. FIGS. 9 and 10 show the image receiving surface 14 in the deployed position.

Figure 11:
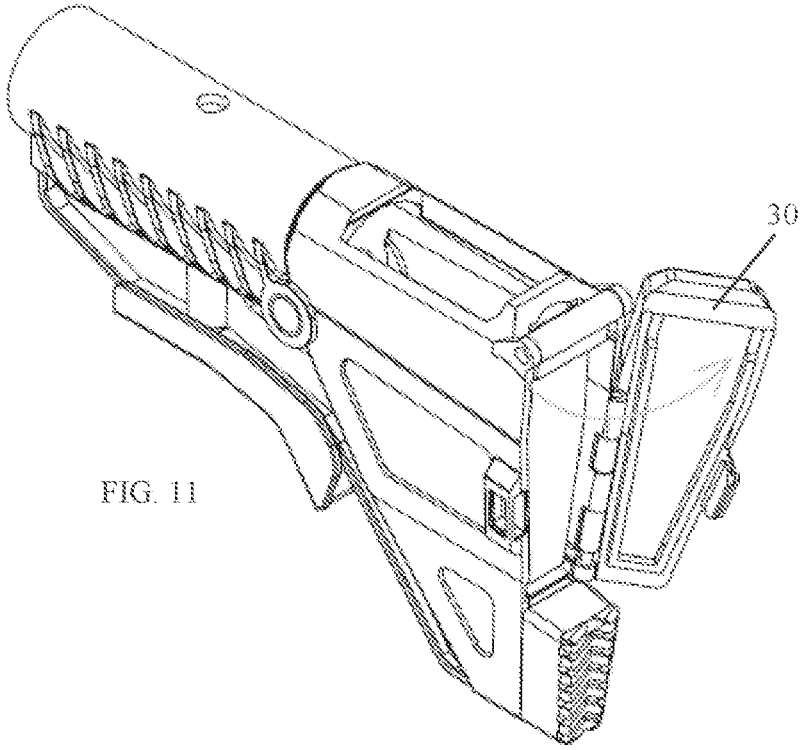
FIGS. 11 and 12 are simplified perspective and sectional illustrations of a buttstock, in accordance with another non-limiting embodiment of the present invention, in which a rear access door protects the image receiving surface of the periscope.
Figure 12:
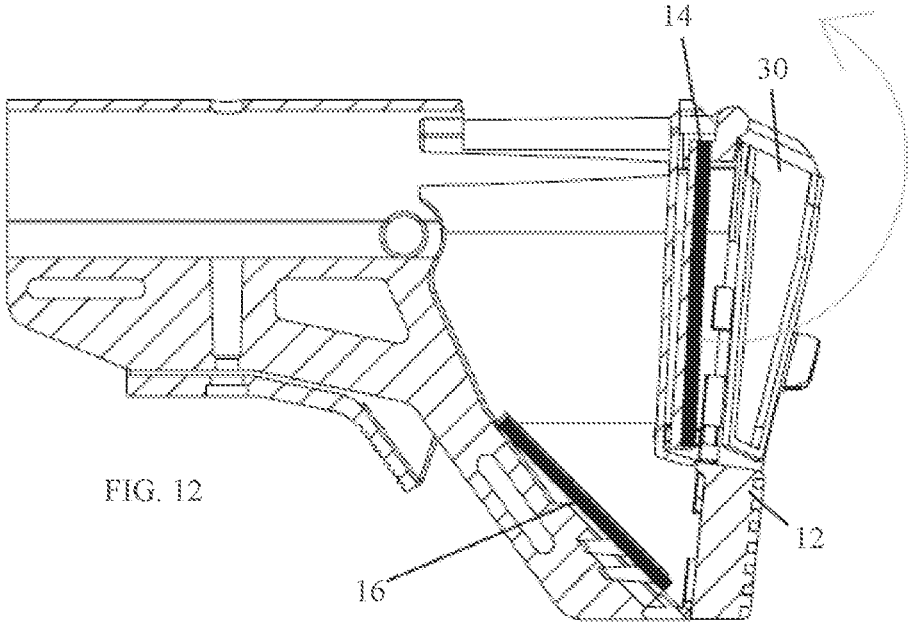
Figure 13:
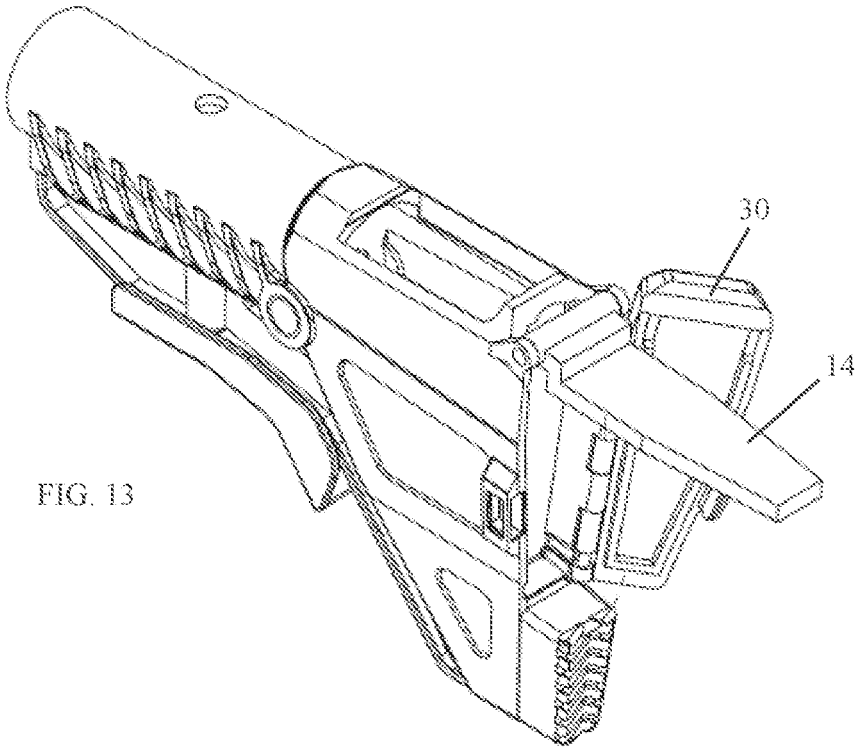
FIGS. 13 and 14 are simplified perspective and sectional illustrations of the buttstock of FIGS. 11 and 12, in which the image receiving surface is in a deployed position.
Figure 14:
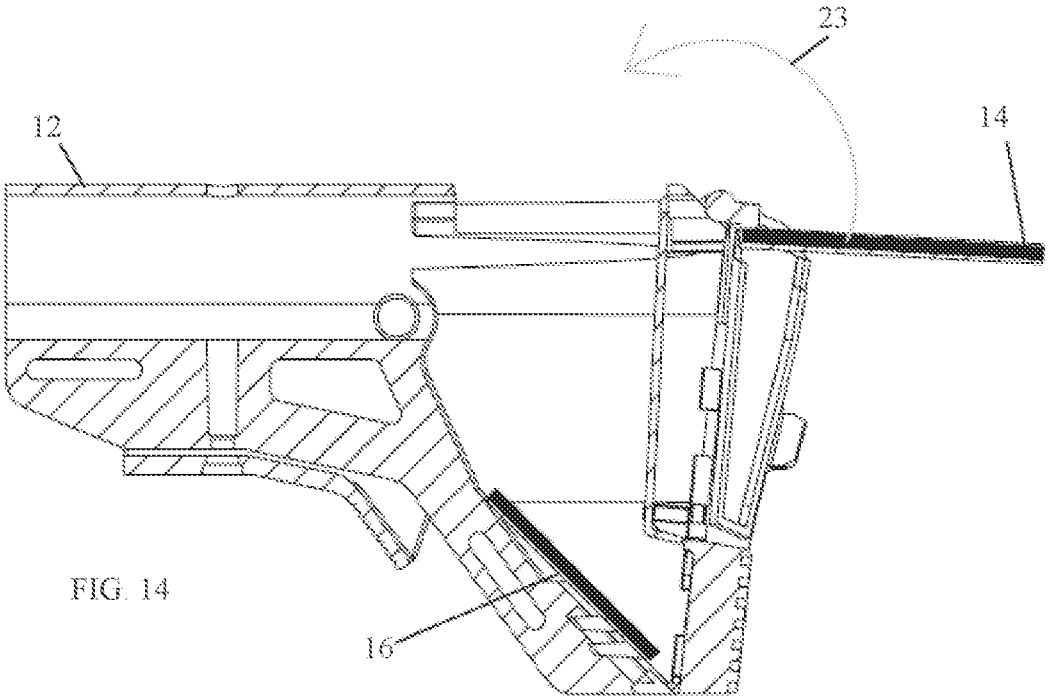

Reference is now made to FIGS. 11 and 12, which illustrate another version of the buttstock assembly, with like elements being designated by like numerals. In this version, a first rear access door 30 covers (protects) the image receiving surface 14 of the periscope. First door 30 may be hinged, and when opened, provides access to image receiving surface 14 so that image receiving surface 14 can be rotated from the retracted position (FIGS. 11 and 12) to the deployed position (FIGS. 13 and 14). (Actually FIGS. 13 and 14 show image receiving surface 14 on its way to the deployed position as indicated by arrow 23 in FIG. 14.)

Figure 15:
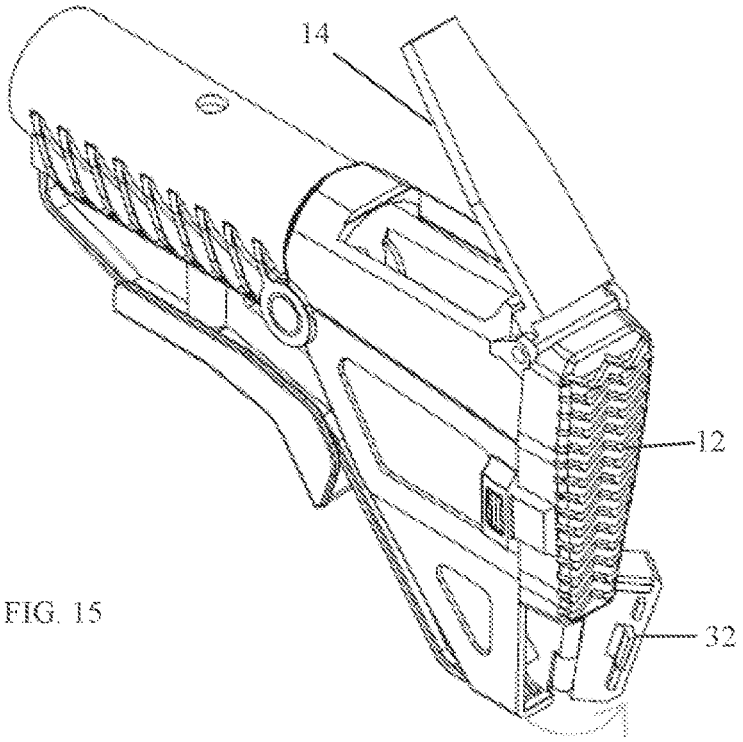
FIGS. 15 and 16 are simplified perspective and sectional illustrations of a buttstock, in accordance with another non-limiting embodiment of the present invention, in which a rear access door protects the image viewing surface of the periscope.
Figure 16:
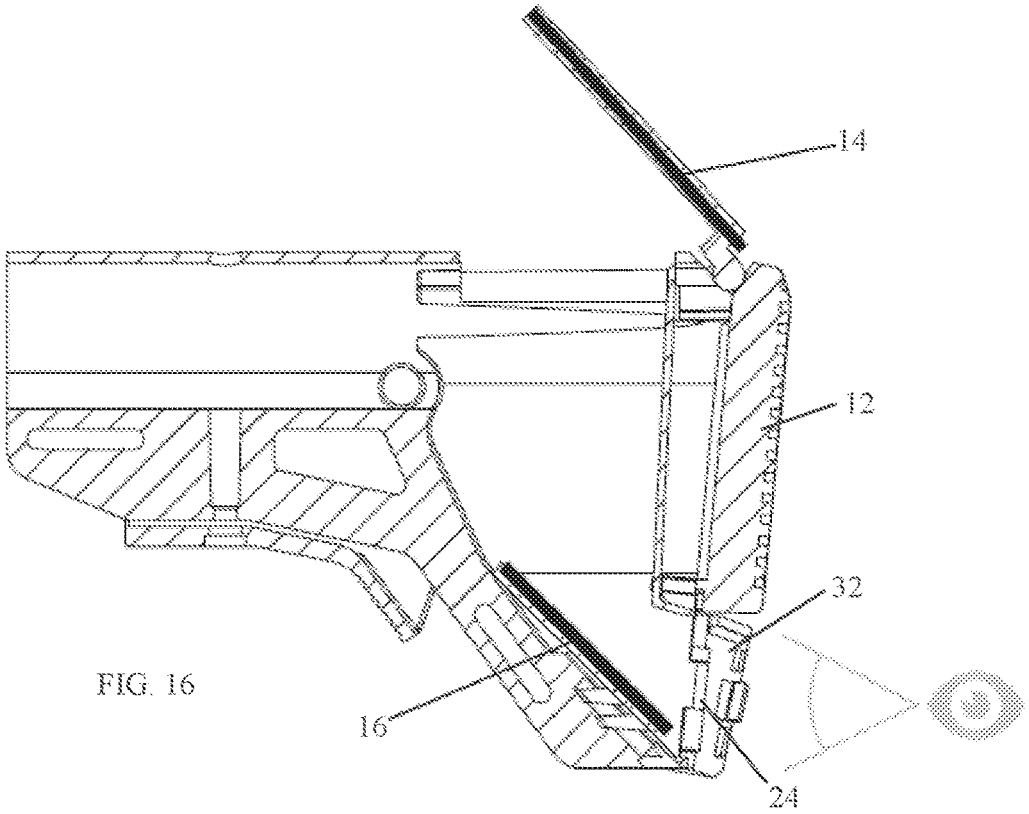

Reference is now made to FIGS. 15 and 16, which illustrate another version of the buttstock assembly, with like elements being designated by like numerals. In this version, a second rear access door 32 covers (protects) the image viewing surface 16 of the periscope. The buttstock can alternatively be supplied with both first and second rear access doors 30 and 32.

Figure 17:
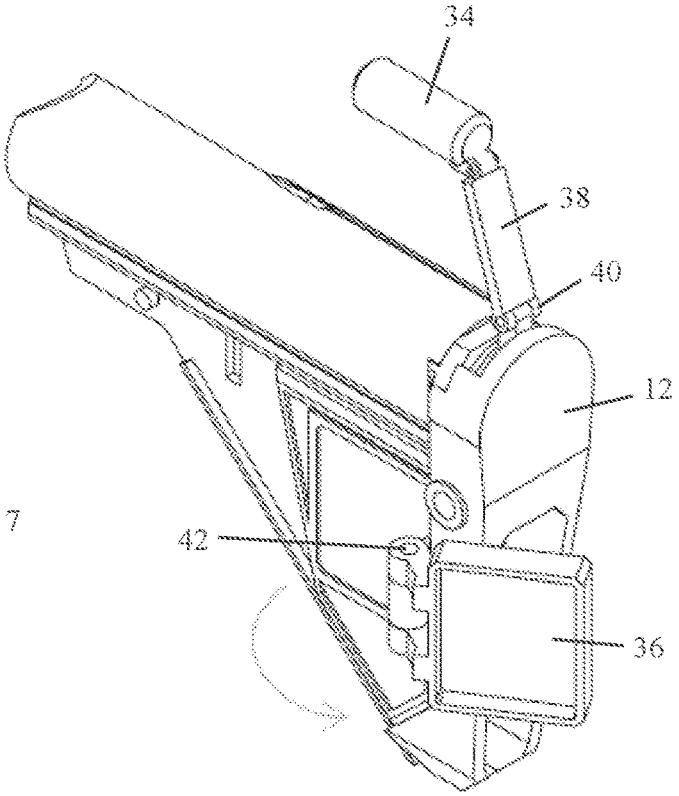
FIGS. 17, 18, 19 and 20 are simplified perspective illustrations of a buttstock, in accordance with another non-limiting embodiment of the present invention, in which the image receiving surface is a camera and the image viewing surface is a screen and they form a periscope, the figures showing the image receiving and image viewing surfaces at different angular positions.
Figure 18:
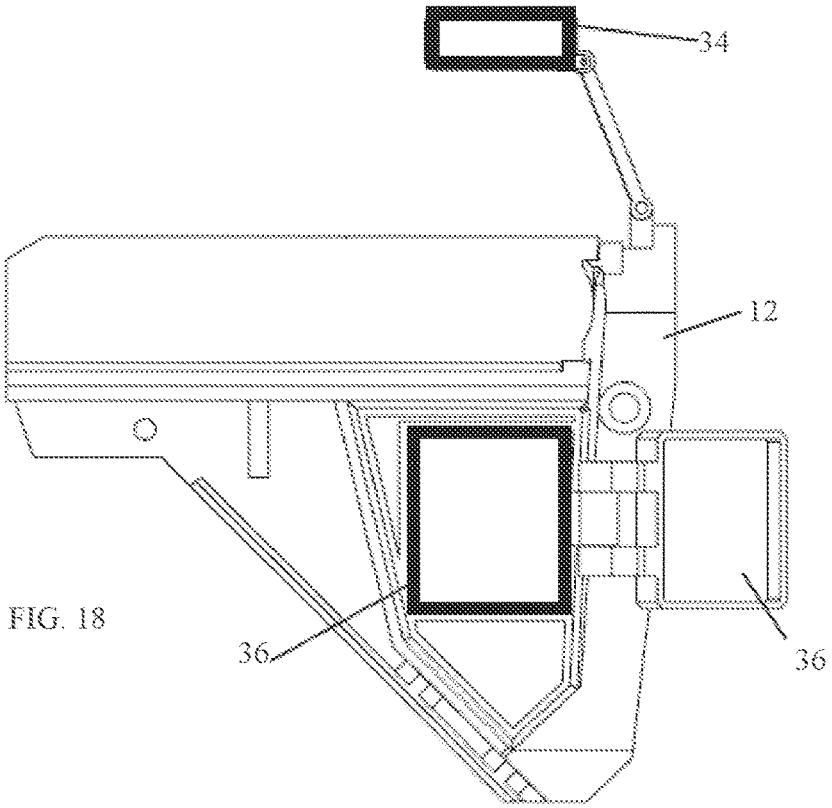
Figure 19:
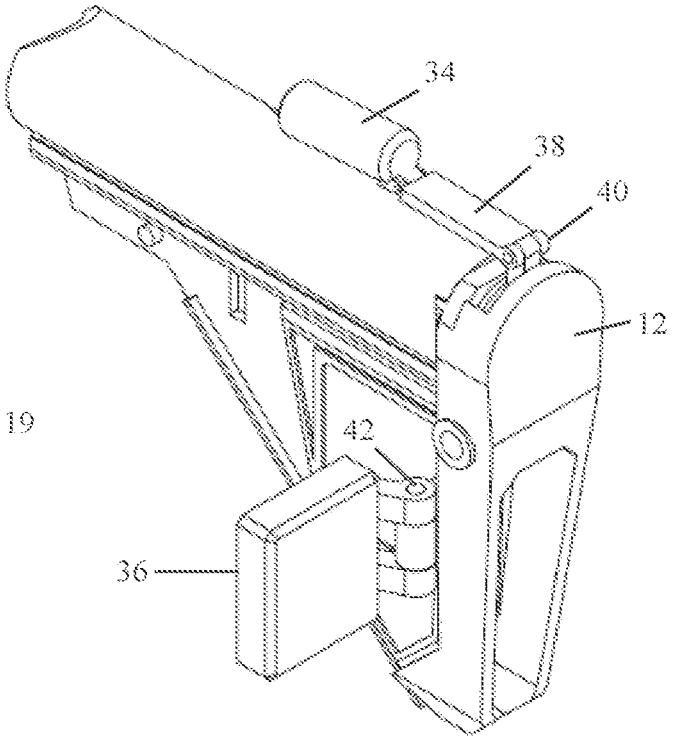
Figure 20:
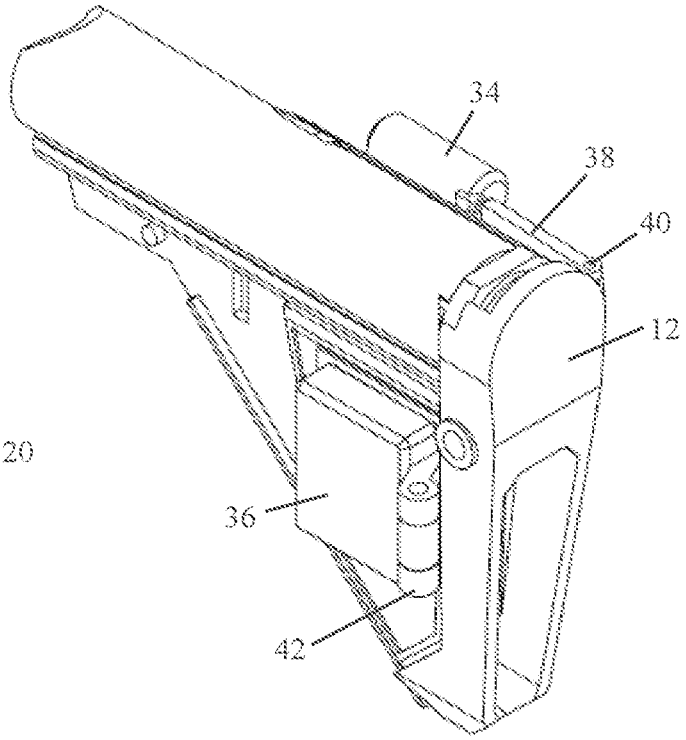

Reference is now made to FIGS. 17 and 18, which illustrate another version of the buttstock assembly, with like elements being designated by like numerals. In this version, the buttstock assembly includes an image receiving surface 34 is a camera and an image viewing surface 36 which is a screen, which is configured to display images received by image receiving surface 34. The image receiving surface 34 and image viewing surface 36 together form a periscope. The image receiving surface 34 may be mounted on an arm 38 pivotable about a pivot 40. The image viewing surface 36 may be pivoted about a pivot 42. FIGS. 17-20 illustrate the image receiving and image viewing surfaces 34 and 36 at different angular positions (and different possible pivot arrangements).

Figure 21:
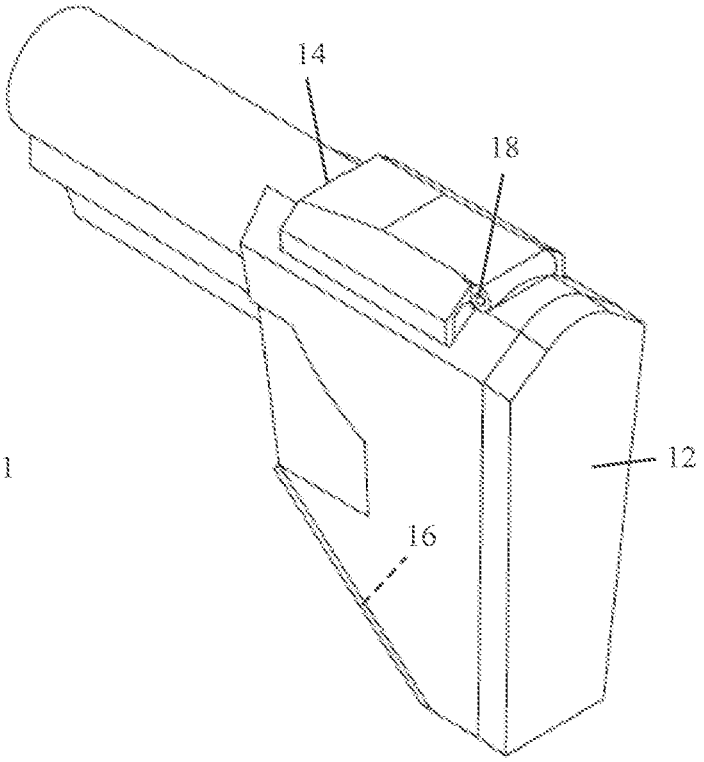
FIGS. 21 and 22 are simplified perspective and sectional illustrations of a buttstock, in accordance with a non-limiting embodiment of the present invention, including image receiving and image viewing surfaces of a periscope, wherein the image receiving and image viewing surfaces are in retracted positions.
Figure 22:
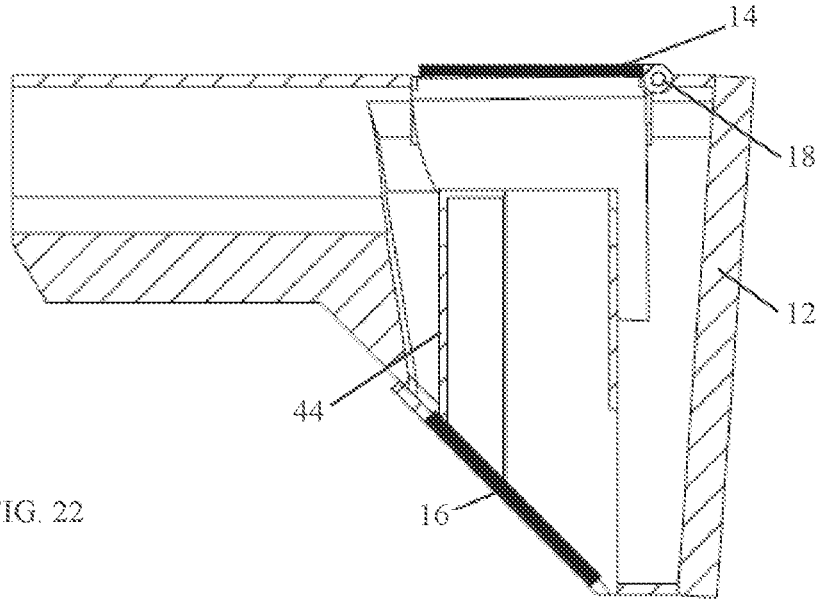
Figure 23:
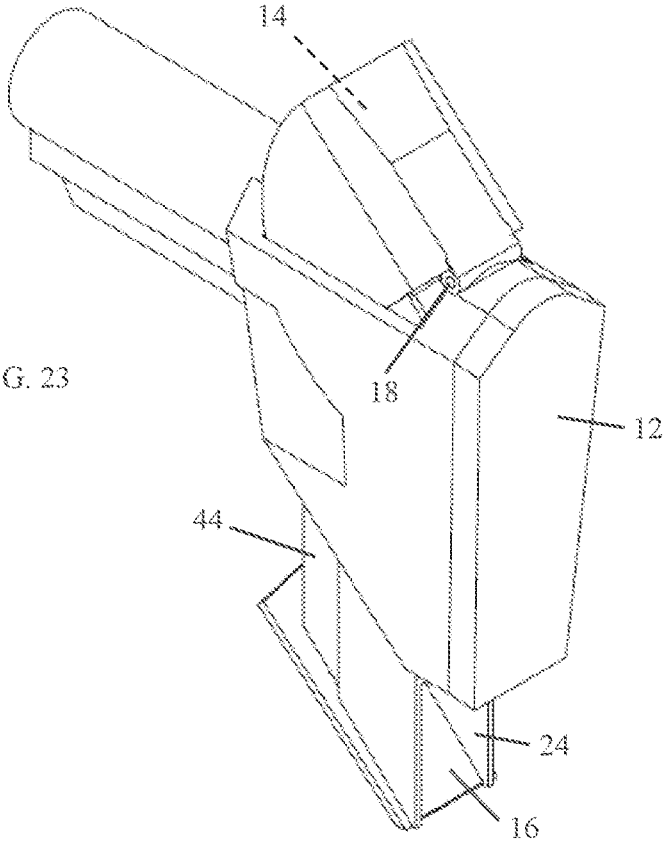
FIGS. 23 and 24 are simplified perspective and sectional illustrations of the buttstock, in which the image receiving and image viewing surfaces are in deployed positions.
Figure 24:
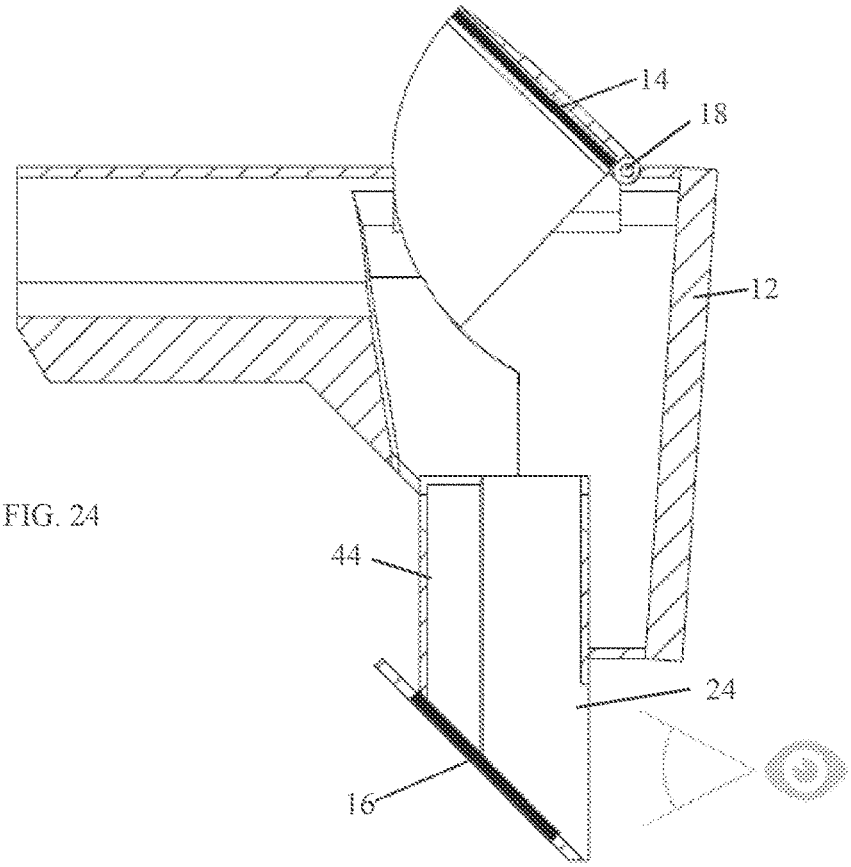

Reference is now made to FIGS. 21-24, which illustrate another version of the buttstock assembly, with like elements being designated by like numerals. In this version, the image viewing surface 16 is not pivotable, but instead translatable. The image viewing surface 16 may be mounted on a sliding member 44, which slides in and out of the lower portion of buttstock 12 ("upper" and "lower" throughout are not limiting and merely refer to the view of the drawings). FIGS. 21 and 22 show the image receiving and image viewing surfaces 14 and 16 in retracted positions; FIGS. 23 and 24 show them in deployed positions.

What is claimed is:

1. A buttstock periscope assembly comprising:

a buttstock comprising a rear face for placing against a shooter's body and a front face opposite said rear face, wherein a longitudinal axis extending from said rear face to said front face is parallel to a shooting axis directed away from the shooter's body; and an image receiving surface and an image viewing surface mounted in or on said buttstock, said image receiving surface having a retracted position, and said image receiving surface and said image viewing surface having deployed positions in which said image receiving surface and said image viewing surface are spaced from each other, wherein said image receiving surface when in the deployed position is aligned with the shooting axis and when in the retracted position is not aligned with the shooting axis, and images captured by said image receiving surface are viewed along said longitudinal axis at said image viewing surface, and wherein said image receiving surface is mounted on a gimbal so that said image receiving surface is pivotable in two angular directions.

2. The buttstock periscope assembly according to claim 1, wherein at said retracted and said deployed positions of said image receiving surface and during movement of said image receiving surface between said retracted and said deployed positions, said image viewing surface remains stationary and coaxial with said longitudinal axis.

3. The buttstock periscope assembly according to claim 1, wherein said image receiving surface and said image viewing surface comprise reflective surfaces.

4. The buttstock periscope assembly according to claim 1, wherein said image receiving surface and said image viewing surface are mounted in a hollow portion of said buttstock.

5. The buttstock periscope assembly according to claim 1, wherein said buttstock comprises a viewing window for viewing said image viewing surface.

6. The buttstock periscope assembly according to claim 5, wherein said viewing window is on said rear surface.

7. The buttstock periscope assembly according to claim 1, wherein said buttstock comprises a second rear access door that covers said image viewing surface.

8. The buttstock periscope assembly according to claim 1, wherein said buttstock comprises an inclined surface upon which said image viewing surface is abuttable in the deployed position.

9. A buttstock periscope assembly comprising:

a buttstock comprising a rear face for placing against a shooter's body and a front face opposite said rear face, wherein a longitudinal axis extending from said rear face to said front face is parallel to a shooting axis directed away from the shooter's body, wherein said buttstock comprises a viewing window on said rear face for viewing said image viewing surface; and an image receiving surface and an image viewing surface mounted in or on said buttstock, said image receiving surface and said image viewing surface having deployed positions in which said image receiving surface and said image viewing surface are spaced from each other, and images captured by said image receiving surface are viewed at said image viewing surface, and wherein said image receiving surface is mounted on a gimbal so that said image receiving surface is pivotable in two angular directions.

10. The buttstock periscope assembly according to claim 9, wherein the images captured by said image receiving surface are viewed along said longitudinal axis at said image viewing surface.

* * * * *